United States Patent [19]

Schmidt

[11] Patent Number: 4,552,083

[45] Date of Patent: Nov. 12, 1985

[54] HIGH-SPEED SEMISUBMERGED SHIP MANEUVERING SYSTEM

[75] Inventor: Terrence W. Schmidt, Cupertino, Calif.

[73] Assignee: Lockheed Missiles & Space Co., Inc., Sunnyvale, Calif.

[21] Appl. No.: 555,828

[22] Filed: Nov. 28, 1983

[51] Int. Cl.[4] ..... B63B 1/12

[52] U.S. Cl. ..... 114/61; 114/277

[58] Field of Search ..... 114/61, 126, 152, 283, 114/277, 278

[56] References Cited

U.S. PATENT DOCUMENTS

| | | | |
|---|---|---|---|
| 1,108,192 | 8/1914 | Lagergren | 114/152 X |
| 3,004,510 | 10/1961 | Nawara | 114/126 |
| 3,623,444 | 11/1971 | Lang | 114/277 X |

FOREIGN PATENT DOCUMENTS

| | | | |
|---|---|---|---|
| 57-590 | 5/1981 | Japan | 114/61 |
| 2058678 | 4/1980 | United Kingdom | 114/61 |

OTHER PUBLICATIONS

"The SWATH Ship Concept and its Potential", *AIAAS/NAME Advanced Marine Vehicles Conference,* Lang, 4–1978.

*Primary Examiner*—David H. Brown
*Attorney, Agent, or Firm*—H. Donald Volk

[57] ABSTRACT

The present invention is directed to maneuvering control systems for small waterplane-area twin hull design watercraft. The maneuvering control system of the present invention includes horizontal or dihedral foils mounted on the lower hulls of the watercraft. The foils may take the form of a one-piece rotatable foil or a foil that includes a plurality of movable sections.

4 Claims, 18 Drawing Figures

2B
2D
2F
2
4
6
14
16
18
20
22
26
34
36
38

FIG_4
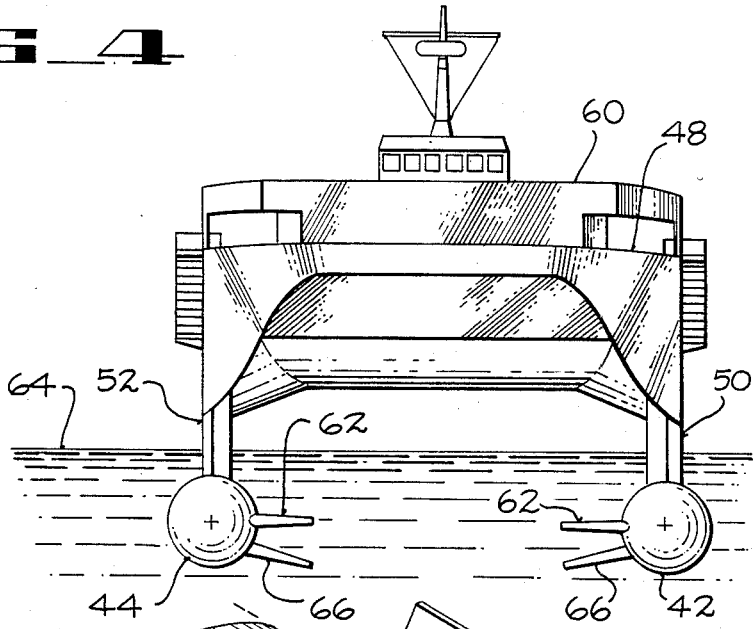
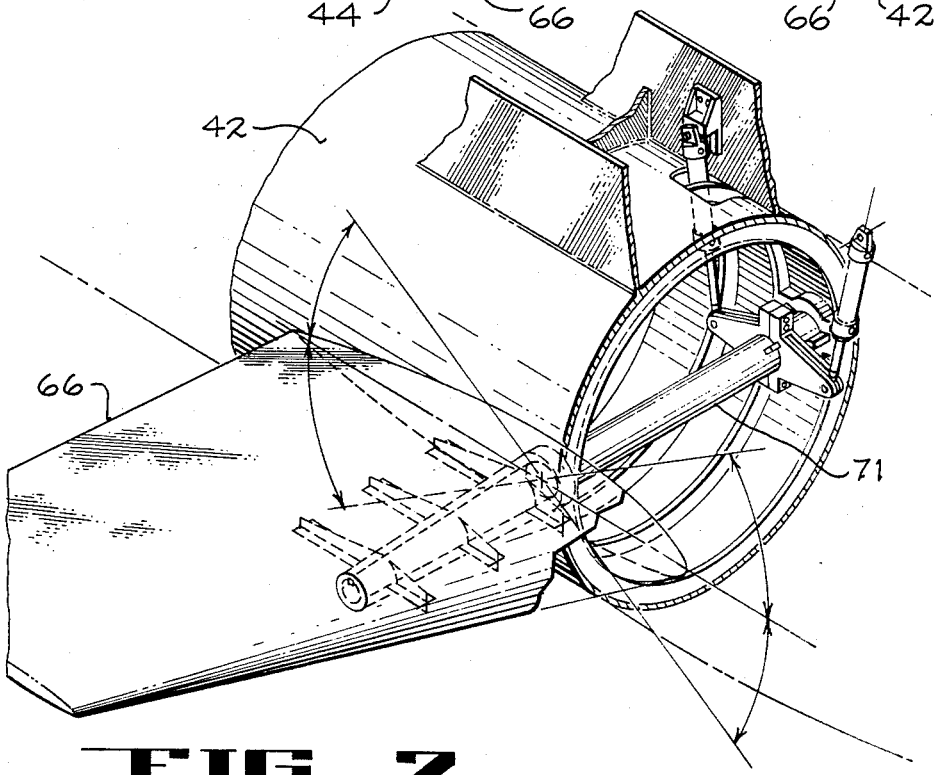
FIG_7

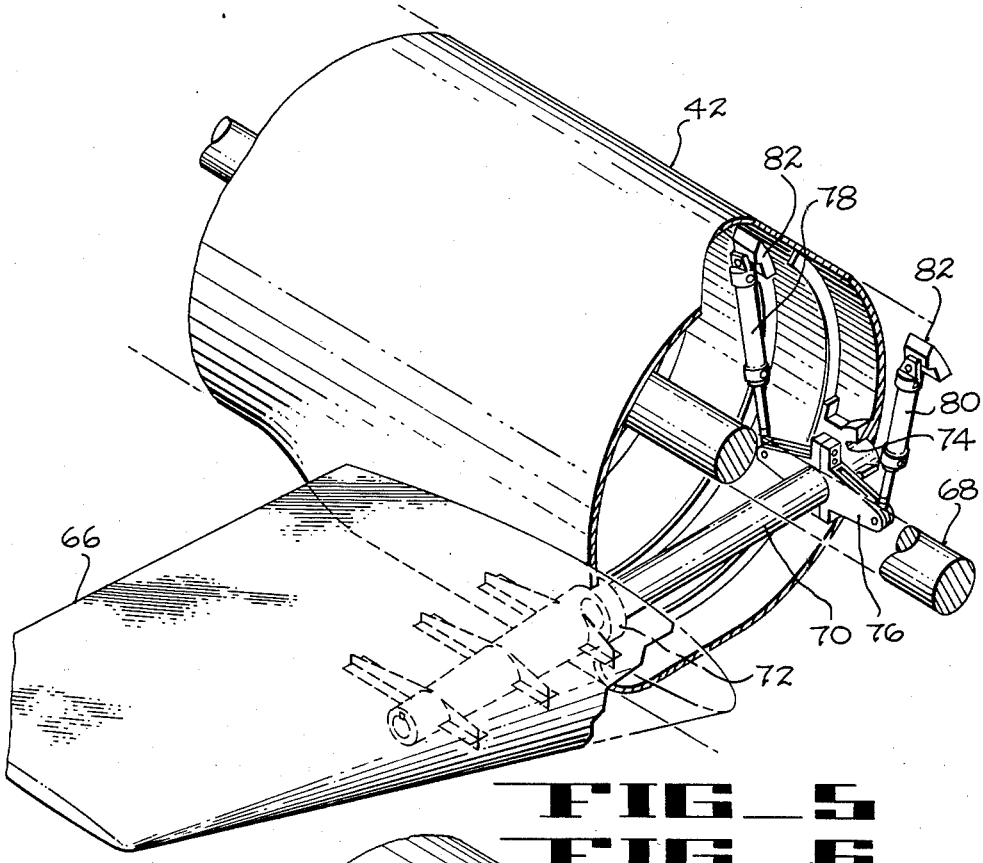
FIG_5
FIG_6
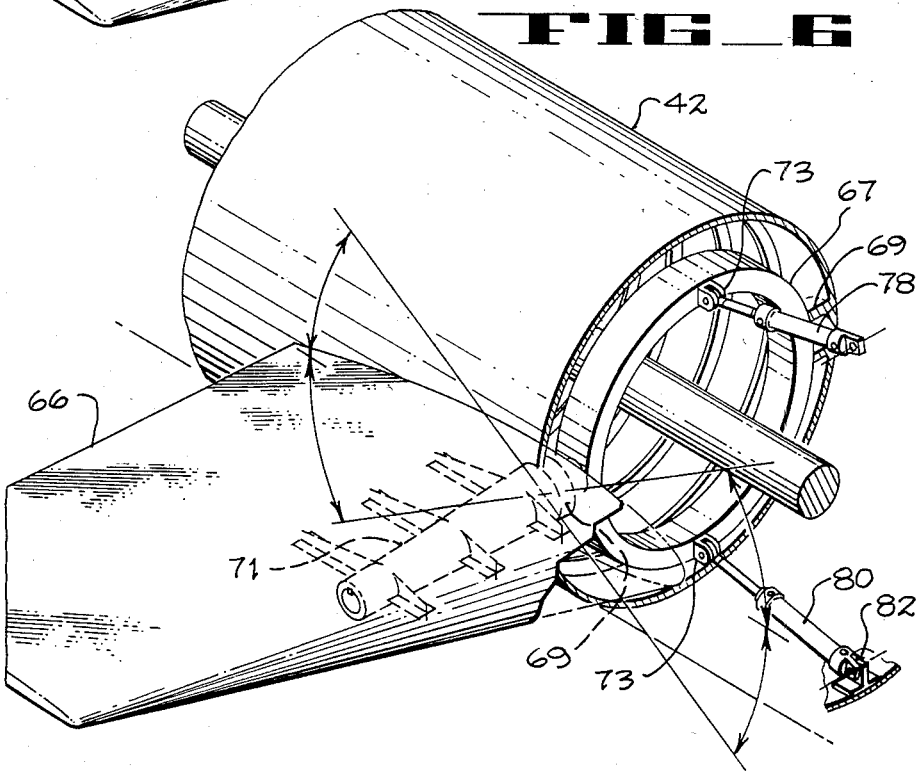

FIG_9A
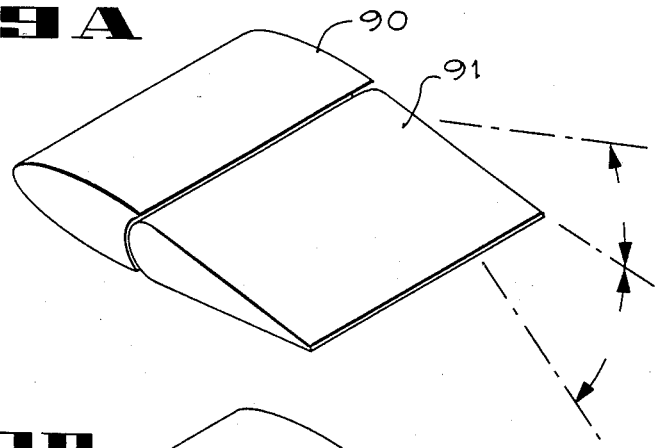
FIG_9B
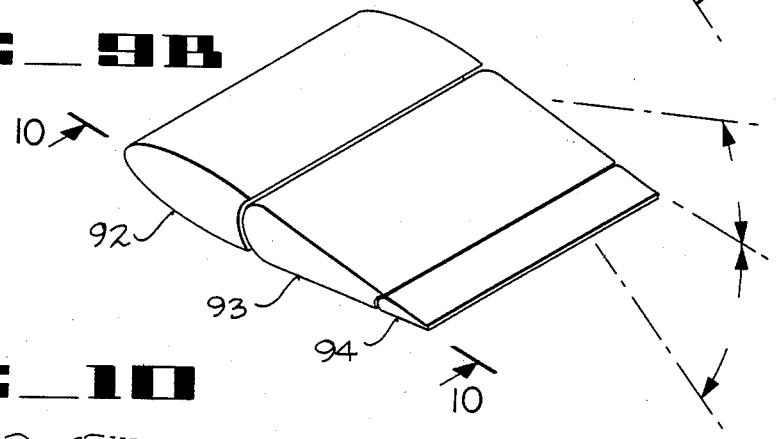
FIG_10
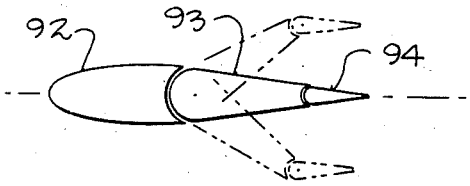
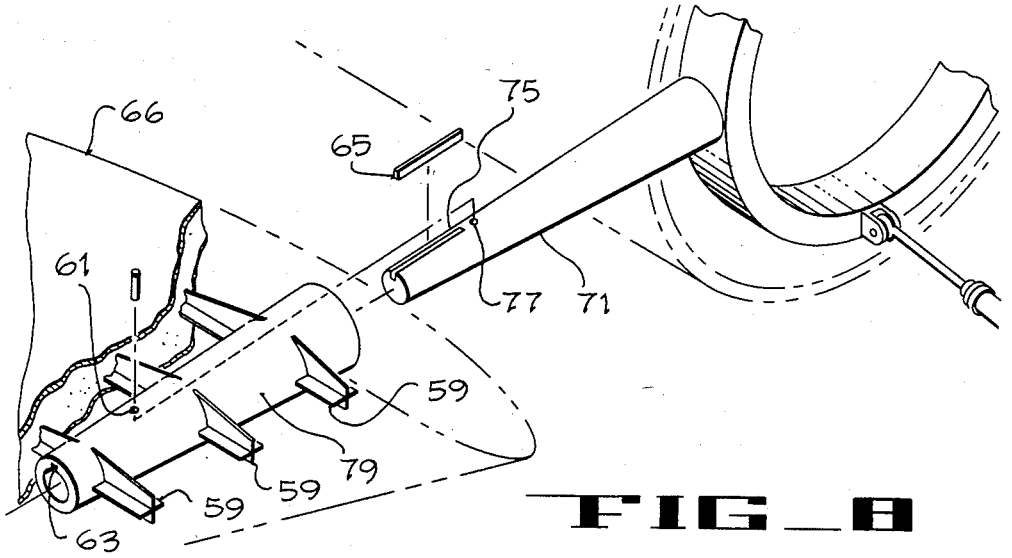
FIG_8

FIG_11
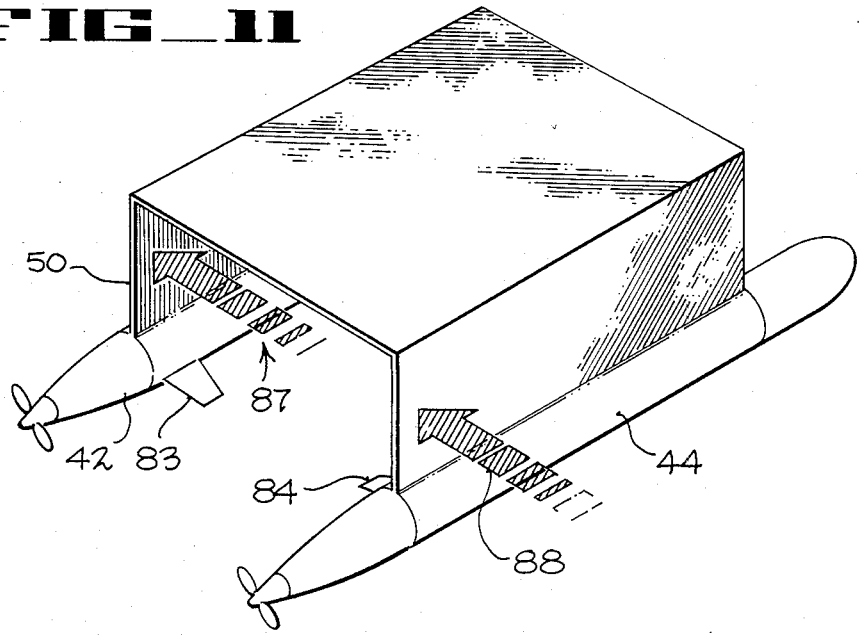
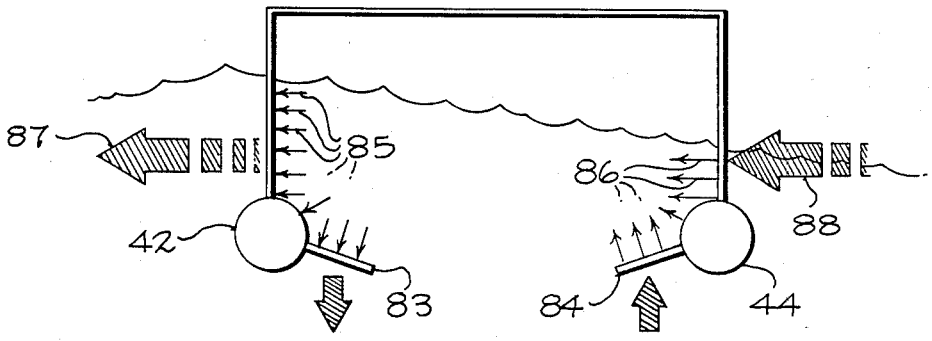
FIG_12

HIGH-SPEED SEMISUBMERGED SHIP MANEUVERING SYSTEM

TECHNICAL FIELD

This invention relates to a maneuvering control system for small waterplane-area twin hull design watercraft. More specifically, the maneuvering control system of the present invention utilizes a non-vertical rudder configuration.

BACKGROUND ART

The conventional method for providing maneuvering control of ships is by use of a rudder mounted vertically at the aft end of the ship. However, when it is attempted to adapt such conventional control systems to small waterplane-area twin hull design watercraft, major structural design problems became evident.

By way of background, semisubmerged or Small Waterplane Area Twin Hull ships, sometimes referred to as SWATH ships, have been developed for high-speed operation at high sea states. THE SWATH ship consists of three major parts: (1) lower hulls which provide the majority of the buoyancy, (2) struts (either single or tandem) that are the vertical structural members that provide the remaining required buoyancy and the necessary ship hydrostatic properties, and (3) an upper cross structure that ties the pair of struts and lower hull assemblies together and provides a working platform. U.S. Pat. Nos. 3,623,444 and 3,897,744 issued to Thomas G. Lang disclose ships of this configuration which have better operational characteristics than conventional ships and can operate at much higher sea states.

As pointed out in U.S. Pat. No. 3,623,444, the effect of surface wave drag on the stability and maximum speed of seagoing vessels is well known to marine designers. Increased sea states magnify the stability and speed problems of vessels due to the inherent pitch, heave and roll tendencies of such vessels.

The above-noted patents to Lang point out a number of configurations for vessels to be operated at high speed under adverse sea conditions. All of these configurations include a pair of lower hulls, an upper cross structure and struts for attaching the upper cross structure to the lower hulls. But, as pointed out by these patents, the mere configuring of a vessel with these components does not solve the speed and stability problems.

The vessel must be hydrodynamically balanced to stabilly operate at high speed in increased sea states.

Optimum or near optimum strut/lower hull forms result when the lower hulls extend aft of the struts. This configuration, although advantageous from a seakeeping, hydrodynamic and power requirement viewpoint presents severe problems for application of conventional ship rudder maneuvering system. The lack of structural support for the rudder has resulted in configuration compromises that shorten the lower hull relative to the strut, which in turn dictates that the rudder be supported from the rear strut. Other approaches include ring rudders, rudders mounted in the prop wash that are supported from the lower hull and strut trailing edge flaps.

DISCLOSURE OF INVENTION

In accordance with the present invention dihedral or horizontal foils are mounted on the lower hull so as to provide maneuvering forces when deflected. To be most effective these foils are located below the lower hull centerline on the aft portion of the ship. Such moveable foils may take the form of a one-piece rotatable foil or a foil having a plurality of movable sections.

Deflection of these foils induces pressures on the lower hulls and struts, thus producing a resultant force that is used to maneuver the ship. By locating the foils below the center line of the lower hull, maximum benefit is obtained from the pressure induced on the lower hull and strut.

BRIEF DESCRIPTION OF DRAWINGS

FIG. 4 is a view looking aft showing the foil arrangement.

FIG. 5 is an isometric view showing a foil control mechanism.

FIG. 6 is an isometric view showing alternative foil control mechanism.

FIG. 7 is an isometric view of the rudder or canard control mechanism located through the hull centerline.

FIG. 8 is an exploded partial view of FIG. 6 showing the foil attachment and structure.

FIG. 9A is an isometric view of a two-section foil.

FIG. 9B is an isometric view of a three-section foil.

FIG. 10 is a side view of a three-section foil, showing, in phantom, the operation of the foil.

FIG. 11 is an isometric view of the ship showing the resultant turning force.

FIG. 12 is a view looking forward of FIG. 11.

BEST METHOD OF CARRYING OUT THE INVENTION

Figures 1, 3:
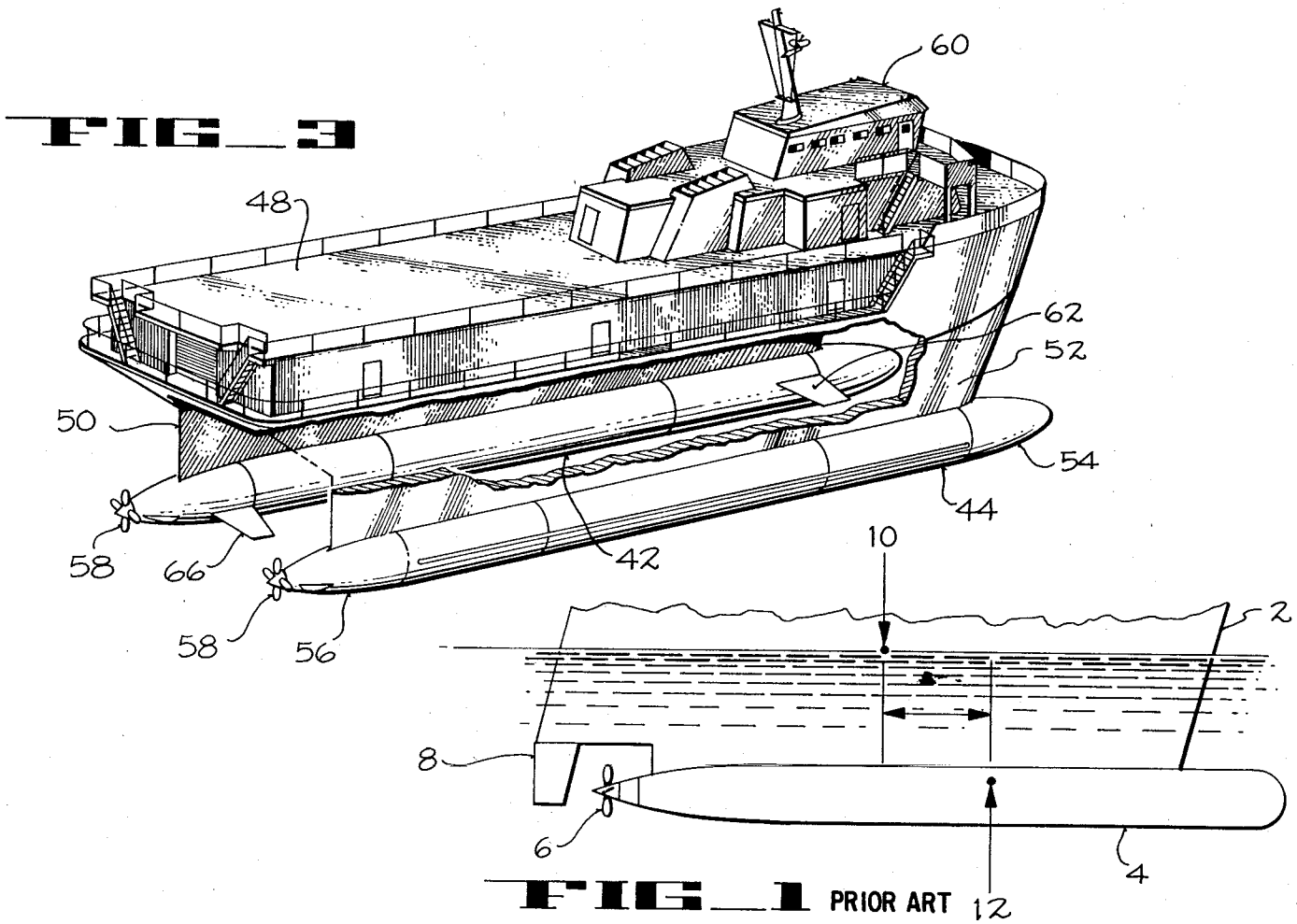
FIG. 1 PRIOR ART
FIG. 1 is a side view of a hull form in which the rudder is supported from the strut.
FIG. 3 is an isometric view of a ship including one form of the present invention.

Referring now to the drawings and more specifically to FIG. 1, a single strut 2 and hull 4 for a SWATH vessel is shown. A propulsion means, such as a propeller 6, is mounted on the rear end of the hull. The strut 2 extends rearward from the hull 4 and a rudder 8 is mounted on the rear portion of the strut 2. In this configuration, the center of buoyancy is located forward of the center of floatation. The center of floatation is indicated by arrow 10 and the ship's center of buoyancy is indicated by arrow 12. Because of the misalignment between the centers of buoyancy and floatation the vessel tends to pitch when it encounters high sea states and the resultant high waves.

Figures 2A, 2B, 2C, 2D, 2E, 2F:
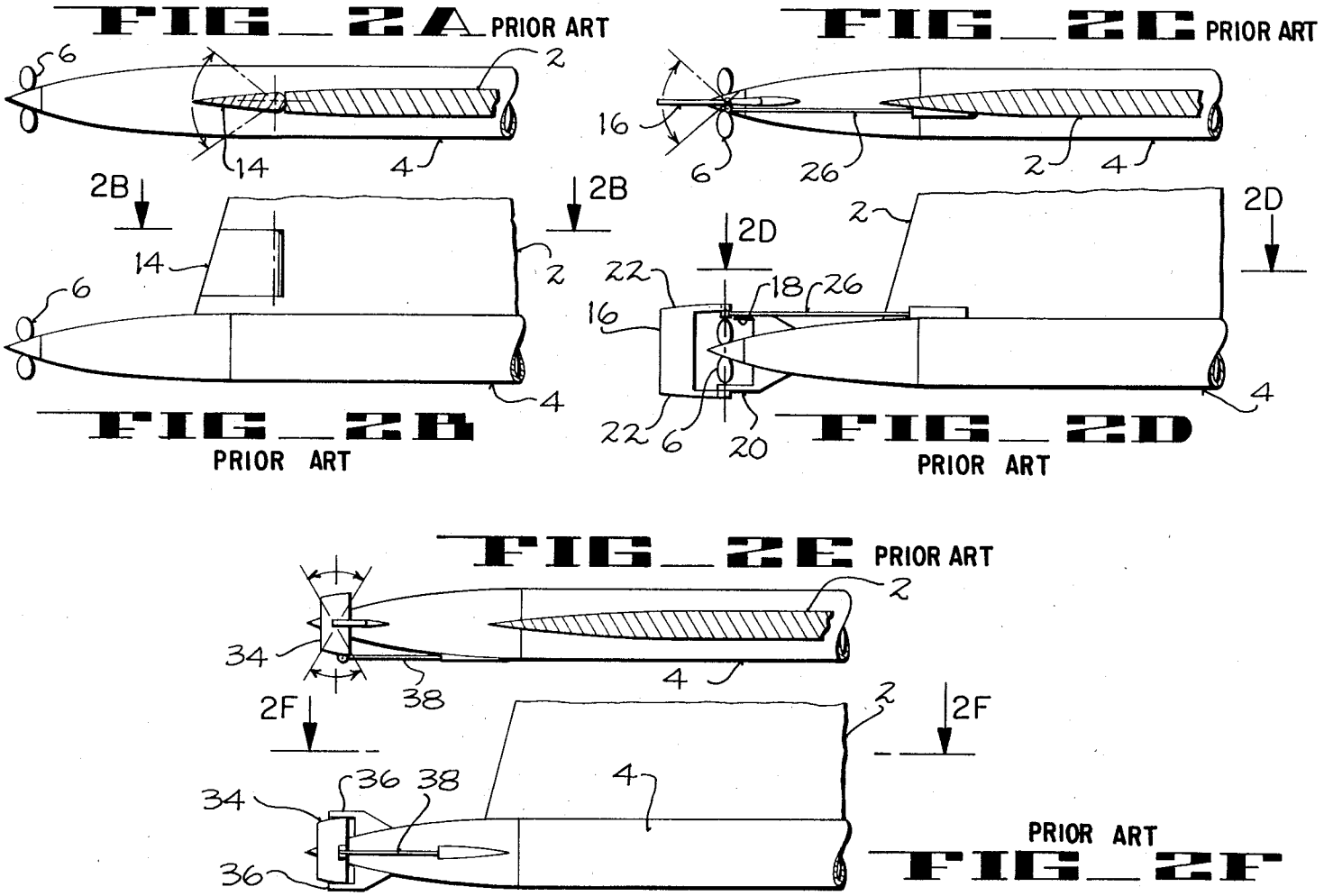
FIG. 2A PRIOR ART
FIG. 2B PRIOR ART
FIG. 2C PRIOR ART
FIG. 2D PRIOR ART
FIG. 2E PRIOR ART
FIG. 2F PRIOR ART
FIG. 2A is a broken away top view of a hull from showing a previous technique for mounting the rudder.
FIG. 2B is a broken away side view of FIG. 2A.
FIG. 2C is a broken away top view of a hull form showing another rudder mounting technique.
FIG. 2D is a broken away side view of FIG. 2C.
FIG. 2E is a broken away top view of a hull form showing yet another previous technique for mounting the rudder on the lower hull.
FIG. 2F is a broken away side view of FIG. 2E.

A number of solutions have been suggested for minimizing this pitch-heave problem. One proposed solution is shown in FIG. 2A and FIG. 2B, in which, for clarity, a single strut 2 and hull 4 is shown. A pivotable rudder 14 is mounted integral to the trailing edge of the strut. With such an arrangement for the rudder, the hull 4 can be extended beyond the strut 2 and the center of buoyancy can be aligned with the center of floatation of the vessel. However, due to the size limitation inherent in the integral rudder 14, the small turning force exerted by the rudder results in the vessel having a large turning radius. Moreover, the water turbulence caused by the integral rudder 14, in turn, causes the propeller 6 to ventilate.

FIGS. 2C and 2D show another design in which a vertical rudder 16 is mounted on the lower hull 4 behind the propeller 6. An upper vertical bracket 18 and lower vertical bracket 20 are attached to the tapered rear extremity of the hull 4. A rudder 16, which includes two support arms 22, is pivotly mounted to the vertical brackets 18, 20. The rudder 16 is moved horizontally by a rudder actuation shaft 26 which can be controlled by any well-known means (not shown). The necessary additional stiffening of the lower hull 4 due to the forces acting on the rudder 16, and the inclusion of the mounting brackets 18, 20 adds undesirable weight to the lower hull 4. Also, mounting the rudder in the propeller wake increases vibration problems. Another disadvantage of this arrangement is that the rudder 16, being mounted on the rear of the hull 4, and being the lowest appendage to the hull 4, is susceptible to being damaged if the vessel runs aground or strikes a submerged object.

FIG. 2E and FIG. 2F show another technique for mounting the rudder on the rear portion of the lower hull. In this instance, the rudder consists of an angular ring 34 which is coaxial with and surrounds the propeller. The ring rudder 34 is pivotly mounted on vertical support brackets 36 and is pivoted in the vertical direction by an offset rudder actuation shaft 38. The ring rudder is less susceptible to vibration than the rudder shown in FIGS. 2C and 2D. However, it is heavier and is susceptible, due to its location, to be damaged.

In the preferred form of the invention depicted in FIGS. 3 and 4, a pair of essentially tubular-shaped parallel submerged hulls 42, 44 provide a buoyancy support for the upper hull 48 through a pair of struts 50, 52. Each of the submerged hulls 42, 44 is made in the form of a long cylindrical shape including a rounded bow 54 and a tapered stern 56.

Individual propellers 58 are mounted on the aft end of each of the submerged hulls 42, 44. The propellers 58 are connected through a suitable transmission to a single power plant, or two individual power plants, to provide forward and reverse thrust for movement of the vessel.

For illustration, the upper hull 48 is shown as a platform that includes a raised forward superstructure 60. Incorporated within the platform are the necessary ship machinery, storage holds, crew quarters and the like.

The supporting struts 50, 52 are long and narrow and are designed to provide a minimal drag and noise producing turbulence. In other words, the struts 50, 52 are designed with a low thicknes to cord ratio.

Attached forward on the inboard side of each submerged hull is a canard 62. The canard 62 is mounted in line with the center point of the hull and is parallel to the normal water surface 64. The canards 62 may be pivotable to aid in steering the vessel. The canards 62 also can be utilized, if desired, to maintain pitch stability and provide roll control.

Rudder stabilizer foil 66 are mounted on the rearward portion of the submerged hulls 42, 44 on the inboard side. The rudder stabilizer foils 66 are mounted below the centerline of the submerged hulls 42, 44. The foils 66 are pivoted for rotation. Foils 66 may be pivoted around their leading edge but in the preferred embodiment, foils 66 are rotated around the point rearward of the leading edge.

To conduct a turn the rudder stabilizer foils would be differentially deflected. For a turn to starboard (right-hand turn) the port foil would be deflected leading edge down thereby creating a high-pressure area on the inboard side of the port strut and hull. Conversely, the starboard foil would be deflected leading edge up, producing a low-pressure region along the inboard surface of the starboard side. The resultant forces on the struts and hulls provide the required yawing (turning) moment necessary to turn the ship.

Referring to FIG. 5, a broken apart section of one of the submerged hulls 42 is illustrated that shows the driveshaft 68 and details of one embodiment of the central foil 66. Support shaft 70 is rotatably mounted within hull 44 by bushing 72 and pilot bushing 74. The support shaft extends to the exterior of hull 42 and is adapted for rigidly supporting the foil 66. Bell crank 76 is rigidly attached to support shaft 70 by a key or the like and is adapted to be connected to a pair of hydraulic cylinders 78, 80. The other end of the hydraulic cylinders 78, 80 are rigidly connected to the interior of hull 42 by blocks 82.

As can be seen from FIG. 5, support shaft 70 and consequently foil 66 is angled downward from horizontal and provides clearance for the propeller driveshaft 68.

FIG. 6 shows another embodiment of the foil control mechanism. In this embodiment a ring 67 is pivotally mounted within the hull by a pair of bushings 69. The foil 66 is rigidly attached to the ring 67 by support shaft 71. One end of pair of hydraulic cylinders 78, 80, which are controlled by conventional means (not shown), are mounted to brackets 73 on the ring by pins or the like. The other end of the pair of hydraulic cylinders are attached by pins or the like to blocks 82 mounted on the interior of hull 42. For clarity, only one block is shown. By differentially operating the pair of hydraulic cylinders 78, 80, the foil 66 can be pivoted as shown by the arrows.

Referring now to FIG. 8, one technique for attaching the foil 66 to the support shaft 71 is shown. The support shaft 71 is tapered and includes a keyway 75 and a pin receiving orfice 77. Formed in the foil 66 is a tapered sleeve 79 adapted to receive the support shaft 71. A pin receiving orifice 61 in the tapered sleeve 79 aligns with the pin receiving orfice 71 in the support shaft 71. Tapered sleeve 79 also includes a keyway 63 for cooperating with the keyway 75 in support shaft for receiving and retaining a key 65. Stiffeners 59 may be made integral with tapered sleeve 79, if desired.

When no propeller drive shaft is involved anywhere within the range or where the drive shaft is offset, the support shaft may extend through the center of the hull. Such an arrangement is shown in FIG. 7.

The yawing moment force exerted by the foil can better be understood with reference to FIGS. 11 and 12. FIG. 12 is a view looking forward. This Figure depicts a right-hand turn and shows the resultant force when the leading edge of the port foil 83 is pivoted down simultaneously with the leading edge of the starboard foil 84 being pivoted up. Looking at the port foil 83, the forces acting on the submerged hull 42, the foil 83 and the strut 50 are shown by arrows 85. Adding these forces together produce the resultant force in the horizontal direction indicated by the arrow 87.

Since the leading edge of the starboard foil 84 is turned upwardly, the forces acting on it are different than the forces acting on the port foil 83. These pressure forces are represented by the small arrows 86 to the left of the starboard hull 44. The resulting horizontal force is shown by the arrow 88 to the right of the starboard 44. Thus it can be seen with reference to FIG. 12 that the total resultant force in the horizontal plane tends to deflect the rear of the ship to the left, causing the ship to turn to the right.

It will be understood that opposite deflections of the foil would tend to turn the ship in the opposite direction.

It should be noted that there is also a resultant vertical force exerted by deflection of the foils 83, 84. In the turn illustrated in FIGS. 11 and 12 the resultant force on the port foil 83 and is in a downward direction while the resultant force on the starboard foil 84 is in the upward direction. The result of these two vertical forces is to give a rolling moment to the ship as it turns. The canards 62 can be utilized to eliminate the roll moment if desired.

Referring specifically to FIG. 4, it can be seen that the foil is angled down from horizontal. The foils may be angled downwardly from horizontal at an angle in the range of 0° to 45°. The appendage configuration shown incorporates the invention with aft foils at 15 degrees dihedral to the horizontal allow maneuvering control. The forward canard appendages also provide additional maneuvering control, however, they are less efficient and for the purpose of this discussion are located horizontally.

Another embodiment of the foil in accordance with the present invention is shown in FIG. 9A. In this embodiment the foil includes a front section 90 and a rear section 91. The front section 90 is rigidly attached to the lower hull. The rear section 91 is attached to, and pivoted from, the front section 90 by any well-known means and extends coextensively with the front section 90. To maneuver the ship, the rear section 91 is pivoted by a hydraulic cylinder or the like (not shown).

A three section foil in accordance with the present invention is shown in FIGS. 9B and 10. In this embodiment the front section 92 of the foil is rigidly attached to the lower hull. The center section 93 of the foil is attached for pivotable movement rearward of the front section 92. In turn, the rear section 94 of the foil is pivotably mounted from, and behind, the center section 93 of the foil. In operation, the rear section 94 is pivoted in the opposite direction from the center section 93. This will be best understood by reference to FIG. 10.

Yawing moment achieved by the use of the foils in accordance with this invention is as large as the moment that can be produced by the use of a conventional vertical rudder. Elimination of the vertical rudder makes the ship less directionally stable (easier to turn) and therefore results in the improved turning capability of a vessel equipped with the foil when compared to the conventional vertical rudder method.

Other modifications and advantageous applications of this invention will be apparent to those having ordinary skill in the art. Therefore, it is intended that the matter contained in the foregoing description and the accompanying drawings is illustrative and not limitative, the scope of the invention being defined by the appended claims.

I claim:

1. A maneuverable small waterplane-area twin hull watercraft, comprising:

a pair of essentially tubular-shaped parallel hulls, each of said hulls including a rounded bow and a tapered stern, a vertical strut mounted to each of said hulls for supporting an upper hull, said parallel hulls extending beyond said vertical struts, an upper hull rigidly attached to the said vertical struts, a propulsion means mounted on the stern of each of said parallel hulls, and foil means mounted on the rearward portion inboard on each of said parallel hulls below the centerline of each of said parallel hulls within the length of the said strut, said foil means being differentially moveable for maneuvering the said watercraft, and wherein said foils are angled downwardly from said parallel hulls at an angle in the range of greater than 0 degrees to 45 degrees.

2. A maneuverable small waterplane-area twin hull watercraft, comprising:

a pair of essentially tubular-shaped parallel hulls, each of said hulls including a rounded bow and a tapered stern, a vertical strut mounted to each of said hulls for supporting an upper hull, said parallel hulls extending beyond said vertical struts, an upper hull rigidly attached to the said vertical struts, propulsion means mounted on the stern of each of said parallel hulls, foil means mounted inboard on each of said parallel hulls below the centerline of each of said parallel hulls within the length of the said strut, said foils are further defined as being pivotably mounted, and wherein said pivotable mount for said foil includes a ring pivotially mounted within each of said parallel hulls, control means for pivoting said ring and the said foil, and said foil means being differentially operable for maneuvering the said watercraft.

3. The maneuverable small waterplane-area hull in claim 2 including a tapered support shaft connected to and extending from said ring, a tapered sleeve mounted integral to said foil adapted to receive said tapered support shaft and means for retaining said tapered support shaft in said tapered sleeve.

4. A maneuverable small waterplane-area twin hull watercraft, comprising:

a pair of essentially tubular-shaped parallel hulls, each of said hulls including a rounded bow and a tapered stern, a vertical strut mounted to each of said hulls for supporting an upper hull said parallel hulls extending beyond said vertical struts, an upper hull rigidly attached to the said vertical struts, propulsion means mounted on the stern of each of said parallel hulls, foil means mounted inboard on each of said parallel hulls below the centerline of each of said parallel hulls within the length of the said strut, said foils are further defined as being pivotably mounted, and wherein said pivotable mount for said foil includes a support shaft rotatably mounted within said hull and extending to the exterior of said hull, said support shaft adapted for rigidly supporting said foil, a bell crank rigidly attached to said support shaft, and control means connected to said bell crank for pivoting the said support shaft and said foil, and wherein said foil means is differentially operable for maneuvering the said watercraft.

* * * * *